United States Patent [19]

Rosenberg et al.

[11] Patent Number: 4,734,665

[45] Date of Patent: Mar. 29, 1988

[54] MICROWAVE FILTER

[75] Inventors: Uwe Rosenberg, Allmersbach i.T.; Dieter Wolk, Korb, both of Fed. Rep. of Germany

[73] Assignee: ANT Nachrichtentechnik GmbH, Backnang, Fed. Rep. of Germany

[21] Appl. No.: 65,566

[22] Filed: Jun. 23, 1987

[30] Foreign Application Priority Data

Jun. 25, 1986 [DE] Fed. Rep. of Germany ..... 3621299

[51] Int. Cl.[4] ..... H01P 1/208; H01P 7/06

[52] U.S. Cl. ..... 333/212; 333/21 R; 333/229

[58] Field of Search ..... 333/202, 208–212, 333/227–231, 21 R, 21 A, 248, 251–252

[56] References Cited

U.S. PATENT DOCUMENTS

| | | | |
|---|---|---|---|
| 3,646,481 | 2/1972 | Den | 333/248 X |
| 3,697,898 | 10/1972 | Blachier et al. | 333/209 X |
| 4,129,840 | 12/1978 | Mok | 333/227 X |

OTHER PUBLICATIONS

Tang and Chaudhuri, IEEE Transactions on Microwave Theory and Techniques, A True Elliptic-Function Filter Using Triple-Mode Degenerate Cavities, vol. MTT-32, No. 11, Nov. 1984, pp. 1449–1454.

*Primary Examiner*—Marvin L. Nussbaum
*Attorney, Agent, or Firm*—Spencer & Frank

[57] ABSTRACT

A microwave filter composed of at least two cavity resonators disposed adjacent one another, and a coupling aperture disposed between the resonators for coupling microwave energy between the resonators, one of the cavity resonators being operative to propagate microwave energy having a TE mode and the other of the cavity resonators being operative to propagate microwave energy having a TM mode, wherein the coupling aperture is constructed for coupling the TE mode in the one cavity resonator with the TM mode in the other cavity resonator.

4 Claims, 3 Drawing Figures

FIG. 1
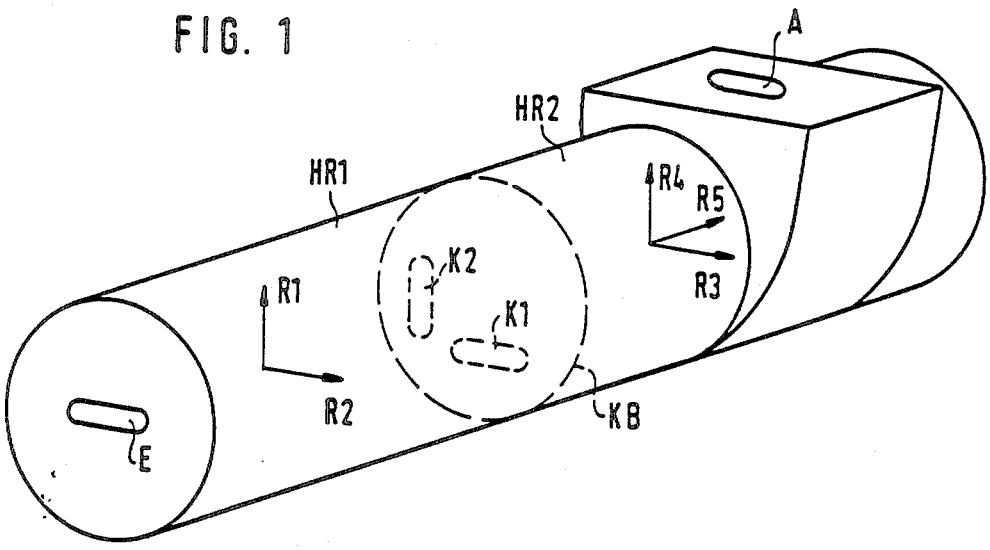
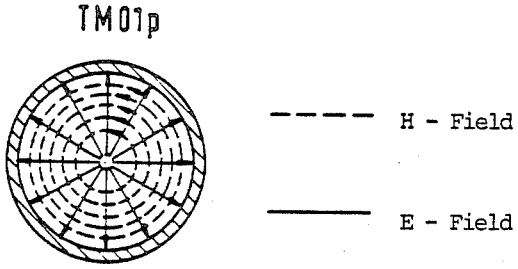
FIG. 2a
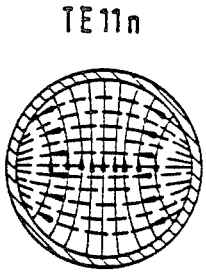
FIG. 2b

MICROWAVE FILTER

BACKGROUND OF THE INVENTION

The present invention relate to a microwave filter composed of at least two cavity resonators in which energy is propagated in at least one TE or TM mode, with a coupling aperture provided between two adjacent cavity resonators coupling together the two modes of the two cavity resonators.

Such a microwave filter is disclosed, for example, in U.S. Pat. No. 3,697,898 and in IEEE TRANSACTIONS ON MICROWAVE THEORY AND TECHNIQUES, Vol. MIT-32, No. 11, November, 1984, pages 1449–1354. The resonant circuits of the microwave filters forming the basis of these disclosures are realized by TE and/or TM modes which oscillate in resonance in the individual cavity resonators. The characteristic of such a microwave filter depends on which mutually orthogonally polarized modes exist in the individual cavity resonators and which of these modes are coupled together. There are couplings between the modes existing in an individual cavity resonator and couplings between modes in different cavity resonators. Mode couplings taking place from cavity resonator to cavity resonator are effected by way of coupling apertures equipped with coupling irises.

SUMMARY OF THE INVENTION

It is an object of the present invention to provide a microwave filter of the above-mentioned type which offers more possibilities for establishing selected filter characteristics than was possible in the prior art.

These and other objections are achieved, according to the invention by a microwave filter composed of at least two cavity resonators disposed adjacent one another, and means including a coupling aperture disposed between the resonators for coupling microwave energy between the resonators, one of the cavity resonators constituting means for propagating microwave energy having a TE mode and the other of the cavity resonators constituting means for propagating microwave energy having a TM mode, wherein the means including a coupling aperture are constructed for coupling the TE mode in the one cavity resonator with the TM mode in the other cavity resonator.

In the microwave filters disclosed in U.S. Pat. No. 3,697,898 and in IEEE TRANSACTIONS ON MICROWAVE THEORY AND TECHNIQUES, couplings between cavity resonators are used only between identical polarity TE modes and between identical polarity TM modes. A plurality of further filter characteristics can be realized if, as in the present application, TM modes in one cavity resonator are also coupled to TE modes of another cavity resonator.

The invention will now be described in greater detail with reference to an embodiment that is illustrated in the drawing.

BRIEF DESCRIPTION OF THE DRAWING

FIG. 1 is a perspective view of a microwave filter according to the invention having two cavity resonators.

FIGS. 2*a* and 2*b* are diagrammatic views showing a TM-01p and a TE-11n mode, respectively.

DESCRIPTION OF THE PREFERRED EMBODIMENTS

The microwave filter shown in FIG. 1 is composed of two cylindrical cavity resonators HR1 and HR2 of which the first cavity resonator HR1 has an input aperture or iris E for coupling in a microwave signal and the second cavity resonator HR2 has an output aperture or iris A for coupling out a signal. Known techniques for coupling microwave signals in and out can be used and will not be discussed in detail here.

The illustrated microwave filter has a total of five resonant circuits, or electrical cavities, R1 . . . R5, of which resonant circuits R1 and R2 are realized in first cavity resonator HR1 and resonant circuits R3 and R4 are realized in second cavity resonator HR2 by TE-11n modes (n=1, 2, 3, . . . ) which have the polarity directions indicated by the associated arrows in FIG. 1. The E-field lines of the TE-11n mode shown in FIG. 2*b* correspond to the direction of polarization of that mode. The fifth resonant circuit R5 of the filter is realized by a TM-01p mode (p=0, 1, 2, . . . ) which is polarized orthogonally to the TE-11n modes. The TM-01p mode is shown in FIG. 2*a*. Its E-field lines extend in the direction of wave propagation, the polarization direction (see arrow R5) of this TM-01p mode.

The orthogonally polarized modes existing in each individual cavity resonator can be coupled by means of discontinuity coupling members, e.g. turning screws inserted in the cavity wall in a known manner.

The modes of the one cavity resonator HR1 are coupled with the modes of the other cavity resonator HR2 by way of a coupling aperture KB provided between the two adjacent cavity resonators. Coupling aperture KB also has an eccentric, slit-shaped coupling iris K1. This coupling iris is disposed at a location where the magnetic field lines or components of the TE-11n mode of resonant circuit R1 in the first cavity resonator HR1 and the magnetic field lines of the TM-01p mode of resonant circuit R5 in the second cavity resonator HR2 are substantially parallel to one another. Thus, these two modes are coupled with one another through the coupling iris K1. Moreover, the coupling iris K1 arranged in this manner also couples the TE-11n mode of resonant circuit R1 of the first cavity resonator HR1 with the identically polarized TE-11n mode of resonant circuit R4 in the second cavity resonator HR2.

Similarly, the TE-11n mode of resonant circuit R2 in the first cavity resonator HR1 can be coupled with the TM-01p mode of resonant circuit R5 and also with the TE-11n mode of resonant circuit R3 in second cavity resonator HR2 by way of a further coupling iris K2 arranged eccentrically with respect to coupling aperture KB and shifted by 90° with respect to coupling iris K1. As indicated by the above statements, it is thus possible to realize a large number of coupling between different types of modes, or more precisely between modes having different polarities, of adjacent cavity resonators by means of a very simple coupling iris structure.

The selected dimensions and position of the coupling iris are determined by the desired center frequency of the filter and the desired coupling between the resonant circuits.

In the above-described embodiment, the microwave filter is composed of only two cavity resonators. Of course it is also possible to construct filters of more than just two cavity resonators, in which case a single mode, dual mode or triple mode exists in each individual cavity resonator, which are then coupled depending on the filter characteristic desired.

The first cavity resonator HR1 has a diameter of 26 mm and a length of 44.5 mm and the second cavity resonator HR2 has a diameter of 22 mm and a length of 49 mm.

The input aperture E which is centered on the front side of the first cavity resonator HR1 has a form of a slot (length: 9.7 mm, width: 3 mm). The output aperture A which has also a form of a slot (length: 10.5, width: 3 mm) is located in the side wall of the second cavity resonator HR2. This output slot A extends in the middle of the second cavity resonator HR2 orthogonally to the longitudinal axis of resonator HR2.

The slit-shaped coupling irises K1 and K2 are dimensioned and eccentrically located in the coupling aperture KB as follows:

Coupling iris K1 has a length of 4 mm and a width of 1.5 mm and coupling iris K2 has a length of 7.1 mm and a width of 1.5 mm. Both coupling irises K1 and K2 are orthogonally oriented to one another whereby coupling iris K1 is displaced for 4.75 mm from the center of the coupling aperture KB and coupling iris K2 is displaced for 4 mm from the center of the coupling aperture KB.

The invention now being fully described, it will be apparent to one of ordinary skill in the art that many changes and modifications can be made thereto without departing from the spirit or scope of the invention as set forth herein.

The present disclosure relates to the subject matter disclosed in German Application No. P 36 21 299.7 of June 25th, 1986, the entire specification of which is incorporated herein by reference.

What is claimed is:

1. In a microwave filter comprising at least two cavity resonators disposed adjacent one another, and means including a coupling aperture disposed between said resonators for coupling microwave energy between said resonators, one of said cavity resonators constituting means for propagating microwave energy having a TE mode and the other of said cavity resonators constituting means for propagating microwave energy having a TM mode, the improvement wherein said means including a coupling aperture are constructed for coupling the TE mode in said one cavity resonator with the TM mode in said other cavity resonator.

2. A microwave filter as defined in claim 1 wherein said coupling aperture extends along a plane and comprises at least one coupling iris disposed at a location where the magnetic field lines of the TM mode are at least approximately parallel to the magnetic field lines of the TE mode in the plane.

3. A microwave filter as defined in claim 1 wherein said other cavity resonator additionally constitutes means for propagating microwave energy having a TE mode polarized in the same direction as the TE mode in said one cavity resonators, and said means including a coupling aperture are further constructed to couple the TE modes in said two cavity resonators.

4. A microwave filter as defined in claim 1 wherein said one of said cavity resonators constitutes means for propagating microwave energy having a first TE mode and a second TE mode, with the first and second TE modes being polarized mutually perpendicularly; said other one of said cavity resonators additionally constitutes means for propagating microwave energy having a third TE mode polarized parallel to the first TE mode, and a fourth TE mode polarized parallel to the second TE mode; and said means including a coupling aperture comprise a first coupling iris for coupling the first TE mode with the third TE mode and the TM mode and a second coupling iris for coupling the second TE mode with the fourth TE mode and the TM mode.

* * * * *